US009151155B2

(12) United States Patent
Braaten et al.

(10) Patent No.: US 9,151,155 B2
(45) Date of Patent: Oct. 6, 2015

(54) DEVICE AND METHOD OF TAKING FLUID SAMPLES OFFSHORE

(75) Inventors: Nils Arne Braaten, Trondheim (NO); Erik Volent, Trondheim (NO)

(73) Assignee: ROXAR FLOW MEASUREMENT AS, Stavanger (NO)

( * ) Notice: Subject to any disclaimer, the term of this patent is extended or adjusted under 35 U.S.C. 154(b) by 0 days.

(21) Appl. No.: 13/203,846

(22) PCT Filed: Mar. 9, 2010

(86) PCT No.: PCT/NO2010/000088

§ 371 (c)(1),
(2), (4) Date: Oct. 20, 2011

(87) PCT Pub. No.: WO2010/104399

PCT Pub. Date: Sep. 16, 2010

(65) Prior Publication Data

US 2012/0031204 A1 Feb. 9, 2012

(30) Foreign Application Priority Data

Mar. 11, 2009 (NO) ..... 20091073

(51) Int. Cl.
*G01N 1/10* (2006.01)
*E21B 49/08* (2006.01)

(52) U.S. Cl.
CPC ..... *E21B 49/086* (2013.01)

(58) Field of Classification Search
None
See application file for complete search history.

(56) References Cited

U.S. PATENT DOCUMENTS

| | | | | | |
|---|---|---|---|---|---|
| 3,812,722 | A * | 5/1974 | Soudelier | 73/863.82 |
| 4,173,886 | A * | 11/1979 | Archbold et al. | 73/31.02 |
| 4,712,434 | A * | 12/1987 | Herwig et al. | 73/864.63 |
| 8,381,578 | B2 * | 2/2013 | Sweeney | 73/49.1 |
| 2008/0022787 | A1 * | 1/2008 | Herzog | 73/863.86 |
| 2010/0058881 | A1 | 3/2010 | Braaten | |
| 2010/0089126 | A1 | 4/2010 | Sweeney | |
| 2012/0096958 | A1 * | 4/2012 | Wulff et al. | 73/864.63 |

FOREIGN PATENT DOCUMENTS

WO 2008 087156 7/2008

* cited by examiner

*Primary Examiner* — Robert R Raevis
(74) *Attorney, Agent, or Firm* — Ladas & Parry LLP

(57) ABSTRACT

A subsea pipeline (10) is provided with a valve (11) which can be operated between a closed position and an open position to establish access from the pipeline exterior to the pipeline interior. The valve (11) is provided with a connector (13) adapted to connect to a sampling tool (16) comprising one or more fluid sampling probes (21). During operation, the fluid sampling tool (16) is transported from a surface location by an ROV down to the subsea pipeline (10) and connected to the valve. Then, the ROV opens the valve (11), moves a sampling probe (21) from the fluid sampling tool (16), through the valve (11) and into contact with the fluid within the subsea pipeline (10) to take fluid samples from the same. When the sampling procedure is completed, the probe is returned back to the sampling tool, and the valve is closed. The ROV disconnects the sampling tool and returns the sampling tool (16) to the surface.

11 Claims, 3 Drawing Sheets

DEVICE AND METHOD OF TAKING FLUID SAMPLES OFFSHORE

This application is a 371 of PCT/NO2010/000088 filed on Mar. 9, 2010, which is incorporated herein by reference.

The present invention concerns a device and a method of taking samples from an underwater device, such as pipelines, wellheads or containers located subsea.

BACKGROUND

During operation of subsea oil and gas drilling installations, samples are being taken continuously to provide information about pressure, temperature, flow rate etc. The results are sent electronically to the surface for use as parameters in analysis or process control.

However, in many circumstances it is desirable to obtain physical samples of the fluid per se, to perform more advanced analyses in a laboratory to provide information for use with calibration of process equipment or to obtain flow information which is impossible to obtain from stationary equipment mentioned above.

The applicant's own Pat. Nos. 323,881 and 325,585 describe a different device and field of utilization, namely a unit for mounting and demounting of a fixed intrusive probe/sensor installed in a pipe. These patents describe a mechanical mechanism used to grip hold of a sensor unit and move it through a cylinder.

The current application is on the other hand related to a way of connecting and filling up with pipe fluids several cylinders contained in a fixed unit, by the use of delta pressure from the pipe to the sample cylinder. This is a different field of utilization using a different method, and cannot be achieved by the teachings of the patents mentioned above.

OBJECTIVE

There is accordingly a need for a device and a method of providing fluid samples from an underwater structure, such as a subsea oil production tubing, and send the samples to the surface for following analysis, without the need for shutting down the subsea production assembly. In other words, it is desirable to be able to take subsea oil or gas samples to the surface during normal well operation.

INVENTION

The objective above is achieved by a device and a method in accordance with the present invention as described in the appended claims.

The device in accordance with the present invention for providing fluid samples from a subsea pipeline is characterized in that the subsea pipeline is provided with a valve which can be operated between a closed position, wherein the pipeline is in a normal operation, and an open position to establish access from the pipeline exterior to the pipeline interior. The valve is provided with a connector adapted to connect to a sampling tool comprising one or more fluid sampling probes.

During operation, the fluid sampling tool is transported from a surface location by an ROV down to the subsea pipeline and connected to the valve. Then, the ROV opens the valve to establish access from the fluid sampling tool interior and the subsea pipeline and moves a sampling probe from the fluid sampling tool, through the valve and into contact with the fluid within the subsea pipeline to take fluid samples from the same. When the sampling procedure is completed, the sampling probe is returned back to the sampling tool through the valve, and the valve is closed to allow the ROV to disconnect the sampling tool from the valve and return the sampling tool to the surface to perform analysis of the fluid sample taken.

Accordingly, the present device and method enables fluid samples to be taken from an underwater fluid assembly without the need for interrupting normal operation.

The invention is described in further details with reference to figures, where

DETAILED DESCRIPTION OF THE INVENTION

Figure 1:
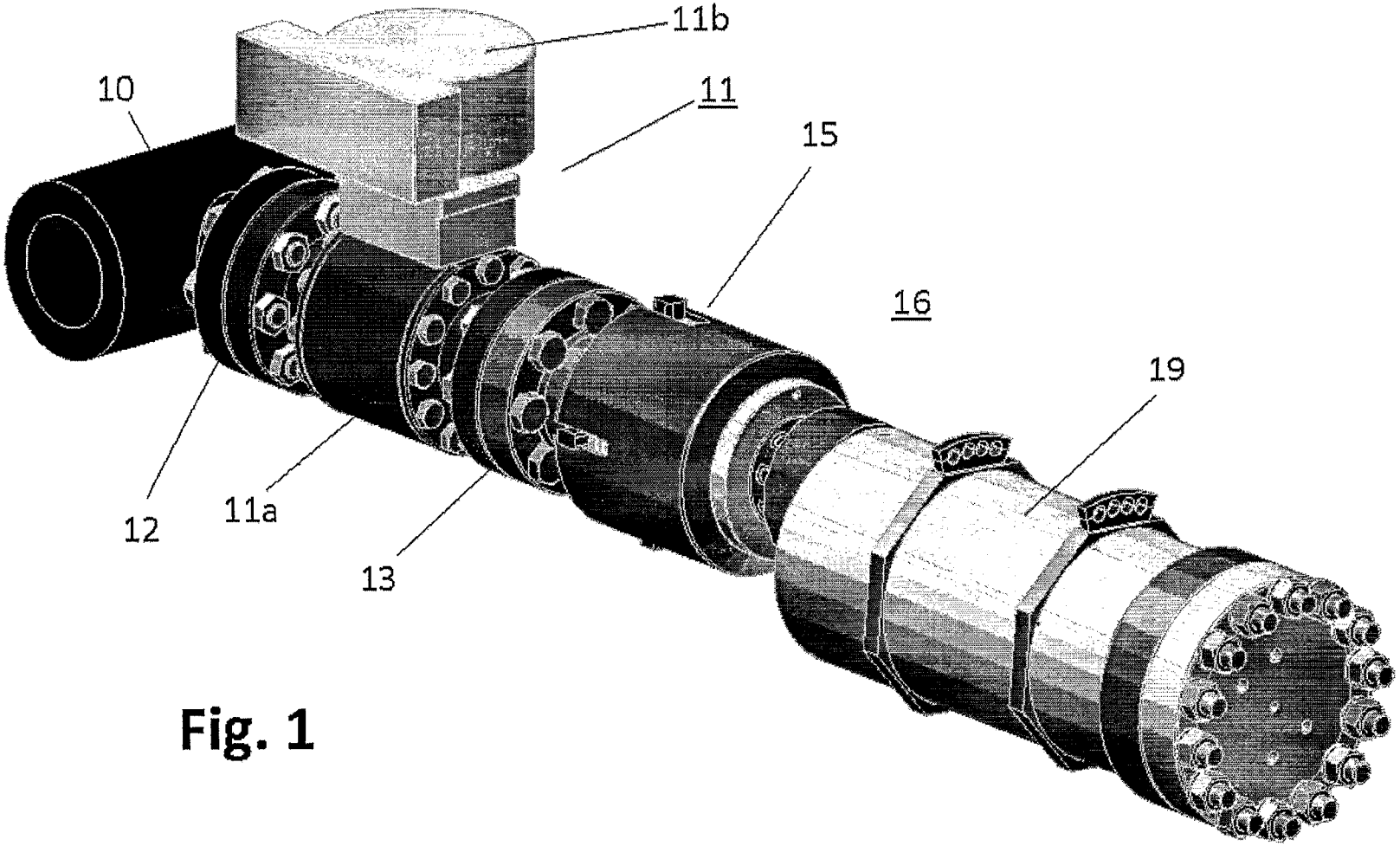
FIG. 1 illustrates a perspective view of a subsea pipeline provided with a valve to obtain access to the pipeline interior and a sampling tool, in accordance with the present invention.

Now referring to FIG. 1, a subsea pipeline 10 is illustrated for transportation of a fluid. A valve 11 comprising a valve housing 11*a* and an actuator 11*b* is connected to the pipeline 10 via a first connector 12, and is provided with a second connector 13 to connect to a sampling tool as described in further detail below. The valve 11 can be operated, remotely or by an ROV, from a closed position to an open position to obtain access from the surrounding sea or water to the interior of the pipeline. A sampling tool generally indicated at 16 exhibits a connector 17 accommodated within a guide housing 15. The sampling tool 16 is operable by a ROV and can be transported to and from a surface vessel or platform (not shown). In FIG. 1, the sampling tool 16 is connected to the valve 11 via said second connector 13 and sampling tool connector 17, which establishes a pressure tight connection between the sea/water and the interior of the sampling tool.

Figure 2:
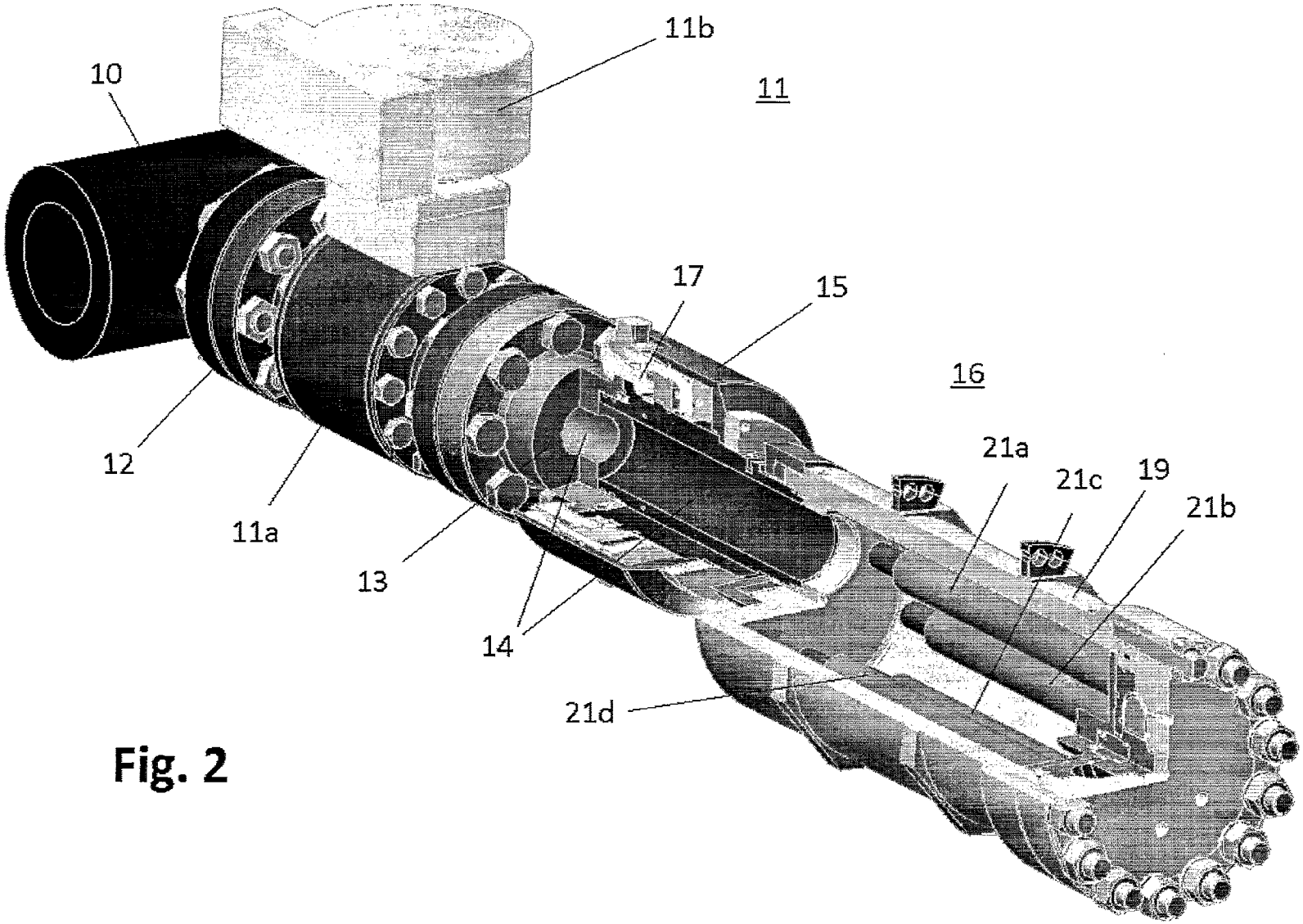
FIG. 2 is a view similar to FIG. 1, but with the sampling tool partially cut away in order to illustrate the interior of the same.
Figure 3:
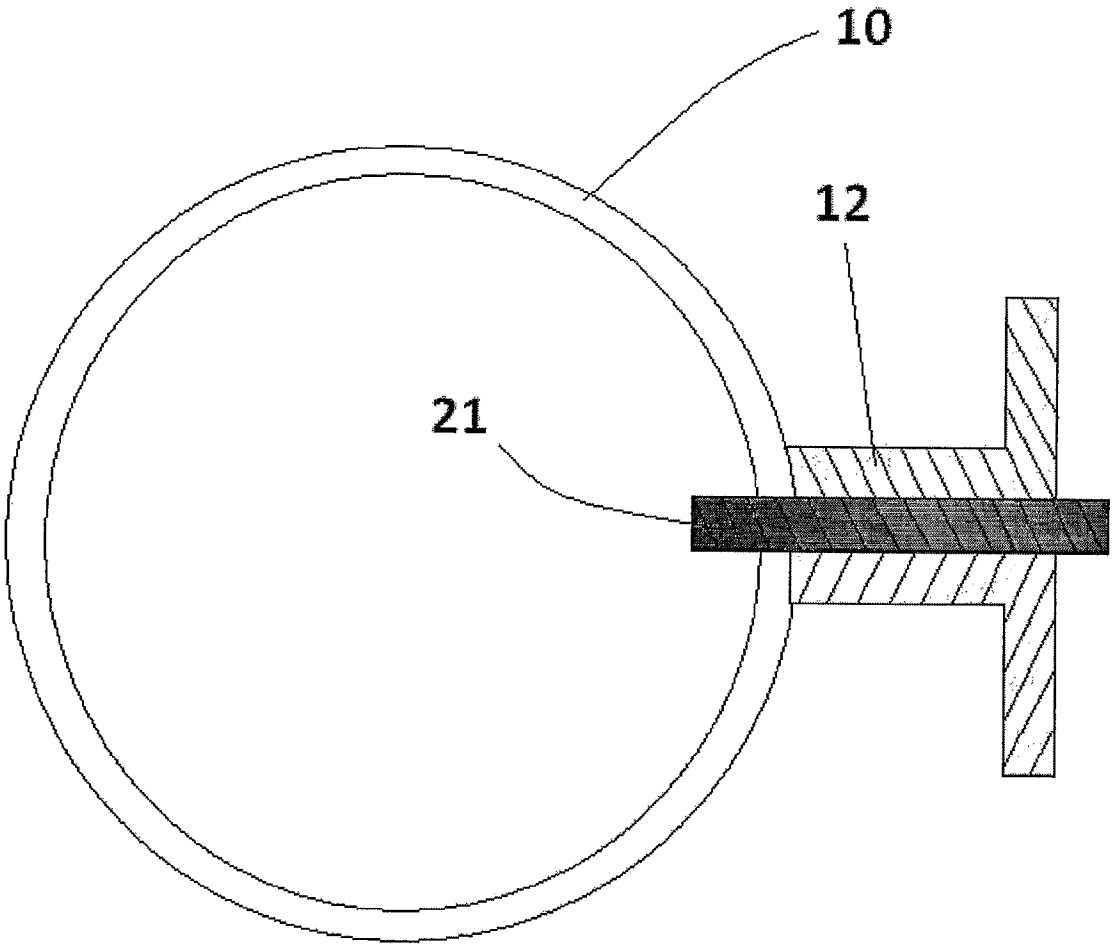
FIG. 3 is a strongly schematically cross-sectional view of a subsea pipeline and a sampling probe in accordance with the present invention.

FIG. 2 illustrates the interior of the sampling tool 12. The sampling tool 16 communicates with the valve 11 bore (not shown) via a guide bore 14 provided in the sampling tool connector 15, 17. One or more sampling probes 21*a*, 21*b*, 21*c*, 21*d* are arranged within a sampling probe container 19, and can be operated by a guidance means (not shown) from a position within the probe container 19, through the guide bore 14 and valve 11 bore and into the interior of the pipe 10, when the valve 11 is in an open position. This position is illustrated schematically in FIG. 3, where the sampling probe 21 is in communication with fluid flowing inside the pipe 10 in order to take physical fluid samples. When the sampling procedure is completed, the sampling probe 21 is retracted from the pipe 10, through the open valve 11 and back into the sampling container 19. Then, the valve 11 can be closed and the sampling tool 16 returned back to the surface vessel by an ROV, where the fluid samples taken from the pipeline can be subjected to analysis.

Now back to FIG. 2, the sampling container 19 is illustrated with multiple sampling probes 21*a*, 21*b*, 21*c*, 21*d* arranged within a rotatable frame or similar, to establish a revolver-like arrangement. In this way, the sampling tool 16 may contain multiple probes to obtain fluid samples from multiple pipelines or positions. After a sampling probe 21 has been returned from the pipeline 10 and secured within the frame, the frame is rotated to place a new sampling probe 21 in position for a new sampling procedure.

The movement of the sampling probe between the pipeline 10 and the sampling container 19 may be effected by controlling the pressure at the respective end of the sampling probe.

I further detail, the pressure is increase behind the rear end of the sampling probe 21 within the sampling container 19 in order to push the sampling probe forward and into the pipeline 10. To the contrary, the pressure at the rear end of the sampling probe 21 is reduced in relation to the fluid pressure within the pipeline 10 in order to retract the sampling probe back into the sampling container 19.

In an alternative embodiment, the sampling probes are kept in place within the sampling container 19, and the end of the sampling container (which is in fluid communication with the valve 11 and pipeline 10) is provided with a valve (not shown). Thus, the sampling procedure occurs as follows: initially, the valve (not shown) at the sampling container 19 is closed; then the probe in question is rotated and aligned with the valve, and both valves are opened to establish fluid communication between the sampling probe 21 and the pipeline. When the sampling procedure is completed, the valve is closed and another sampling probe is rotated into position in alignment with the valve, or the sampling tool is disconnected and returned to the surface. Accordingly, the sampling procedure is performed while the sampling probes are kept in place within the sampling container 19.

The invention claimed is:

1. A device for providing fluid samples from an underwater structure comprising a wall and a port provided in the wall, said device comprising:

a valve unit connectable to said port by a first connector to establish communication between the interior of the underwater structure and the exterior, wherein the valve unit includes a second connector to establish a connection with an external sampling tool, wherein said valve unit can be positioned from a closed position during normal operation of the underwater structure, to an open position, to establish communication between the fluid within the underwater structure and said second connector, wherein said tool comprises a connector which can establish a connection with the second valve connector and provides a communication between the interior of the sampling tool and the fluid within the interior of the underwater structure, wherein said tool comprises at least one sampling probe adapted to be brought in fluid communication with the underwater structure to take fluid samples from the underwater structure to be transported to the surface, and wherein the sampling tool is directly connected to said underwater structure by said first connector.

2. The device of claim 1, wherein the sampling tool is adapted to be transported between a surface location and the valve unit, and connected and disconnected from the valve unit by an ROV.

3. The device of claim 1, wherein the underwater structure is a conduit or wellhead assembly.

4. A method of taking fluid samples from an underwater structure, comprising the steps of:

providing the underwater structure with a shutoff valve, which can establish communication or access between the interior of the underwater structure and the exterior of the same when said valve is in an open position, providing a sample tool comprising a sampling probe capable of taking fluid samples, and provided with a connection for establishing a pressure-tight connection with the valve, transporting said sampling tool from a surface location down to the valve, position the tool, and establish a connection with the valve, opening the valve to establish access between the interior of the sampling tool and the interior of the underwater structure, taking a fluid sample using a sampling probe, closing the valve, returning the sampling tool back to the surface location with the fluid sample taken, and directly connecting the sampling tool to said underwater structure by a first connector.

5. The method of claim 4, wherein the underwater structure is a conduit or wellhead assembly.

6. The method of claim 4, wherein the valve comprises a housing and an actuator.

7. The method of claim 4, wherein the sample tool connection is disposed within a housing.

8. The method of claim 4, wherein the sampling probe is disposed within a sampling probe container.

9. A method of taking fluid samples from an underwater structure comprising the steps of:

providing the underwater structure with a shutoff valve, which can establish communication or access between the interior of the underwater structure and the exterior of the same when said valve is in an open position, providing a sample tool comprising a sampling probe capable of taking fluid samples, and provided with a connection capable of establishing a pressure-tight connection with the valve, transporting said sampling tool from a surface location down to the valve, positioning the tool, and establishing a connection with the valve, bringing the sampling probe into a position capable of establishing a fluid communication with said underwater structure, opening the valve to establish access between the interior of the sampling tool and the interior of the underwater structure, establishing fluid communication between the underwater structure and the sampling probe, taking fluid samples using the sampling probe, closing the valve, returning the sampling tool back to the surface location with the fluid sample taken, and directly connecting the sampling tool to said underwater structure by a first connector.

10. The method of claim 9, wherein the underwater structure is a conduit or wellhead assembly.

11. A device for providing fluid samples from an underwater structure comprising a wall and a port provided in the wall, said device comprising:

a valve unit comprising a housing and an actuator, wherein said valve unit is connectable to said port by a first connector to establish communication between the interior of the underwater structure and the exterior, wherein the valve unit includes a second connector to establish a connection with an external sampling tool, wherein said valve unit can be positioned from a closed position during normal operation of the underwater structure, to an open position, to establish communication between the fluid within the underwater structure and said second connector, wherein said tool comprises a connector disposed within a housing, wherein said connector establishes a connection with the second valve connector and provides a communication between the interior of the sampling tool and the fluid within the interior of the underwater structure, and wherein said tool comprises at least one sampling probe disposed within a sampling probe container that is connected to the housing, wherein said sampling probe is adapted to be brought in fluid communication with the underwater structure to take fluid samples from the underwater structure to be transported to the surface, and wherein the sampling tool is directly connected to said underwater structure by said first connector.

* * * * *